US012123695B2

(12) United States Patent
Song et al.

(10) Patent No.: US 12,123,695 B2
(45) **Date of Patent: *Oct. 22, 2024**

(54) HIGH-STIFFNESS ARROW SHAFT AND METHOD OF MANUFACTURING THE SAME

(71) Applicants: Yun Il Song, Busan (KR); Yun Sub Song, Busan (KR); Yun Jae Song, Busan (KR)

(72) Inventors: Yun Il Song, Busan (KR); Yun Sub Song, Busan (KR); Yun Jae Song, Busan (KR)

( * ) Notice: Subject to any disclaimer, the term of this patent is extended or adjusted under 35 U.S.C. 154(b) by 103 days.

This patent is subject to a terminal disclaimer.

(21) Appl. No.: 17/722,348

(22) Filed: Apr. 17, 2022

(65) Prior Publication Data

US 2023/0332872 A1 Oct. 19, 2023

(51) Int. Cl.
*F42B 6/04* (2006.01)

(52) U.S. Cl.
CPC ..... *F42B 6/04* (2013.01)

(58) Field of Classification Search
CPC ..... F42B 6/04
See application file for complete search history.

(56) References Cited

U.S. PATENT DOCUMENTS 6,758,773 B1 * 7/2004 Liao ..... F42B 6/003 473/578
6,866,599 B2 * 3/2005 Eastman, II ..... F42B 6/04 473/578
7,201,818 B2 * 4/2007 Eastman, II ..... F42B 6/04 156/172
8,579,739 B2 * 11/2013 Song ..... F42B 6/04 473/578
9,194,671 B1 * 11/2015 Song ..... F42B 6/04
10,907,942 B2 * 2/2021 Greenwood ..... F42B 6/04
2003/0073524 A1 * 4/2003 Song ..... F42B 6/04 473/578
2006/0084534 A1 * 4/2006 Flowers ..... F42B 6/04 473/578
2017/0321999 A1 * 11/2017 Hoefer ..... B29C 63/0073

FOREIGN PATENT DOCUMENTS

KR 10-2002-0057554 A 7/2002

* cited by examiner

*Primary Examiner* — John A Ricci

(74) *Attorney, Agent, or Firm* — Insight Law Group, PLLC; Seung Lee

(57) ABSTRACT

The present disclosure relates to a high-stiffness arrow shaft, which has an arrowhead disposed at one side thereof and a nock disposed at the other side thereof, and a method of manufacturing the same, the high-stiffness arrow shaft including at least one sheet layer arranged in one direction while being stacked and wound around at least a part of a body of the arrow shaft, in which at least a part of the sheet layer is made of a semi-transparent or transparent material, and a plurality of carbon fiber reinforcing sheets is disposed at predetermined angles in at least one of a plurality of sheet parts.

8 Claims, 9 Drawing Sheets

HIGH-STIFFNESS ARROW SHAFT AND METHOD OF MANUFACTURING THE SAME

BACKGROUND OF THE DISCLOSURE

Field of the Disclosure

The present disclosure relates to a high-stiffness arrow shaft having high strength and a method of manufacturing the same.

Description of the Related Art

In general, an arrow includes an arrow shaft which is a cylindrical hollow body, an arrowhead mounted at a front end of the arrow shaft, a nock mounted at a rear end of the arrow shaft, and fletching attached to an outer peripheral surface of a rear side of the arrow shaft.

When the arrow is repeatedly launched several times, a paradox phenomenon more significantly affects the arrow shaft than expected. The arrow shaft is bent like a bow while changing directions thereof numerous times about a pressure point (center of gravity) while the arrow is flying. When this phenomenon is consistently repeated, a middle portion of the arrow shaft, on which a center of gravity is positioned, is deformed or damaged.

The archer's paradox phenomenon occurs at the moment when the arrow is launched from the bow. In this case, if strength, a weight, a length, or the like of the arrow shaft is not suitable for strength of the bow, the arrow does not fly straight.

In general, high stiffness of the spine of the arrow means that strength of the arrow, i.e., stiffness of the spine of the arrow is higher than strength of the bow, and low stiffness of the spine of the arrow means that strength of the arrow is lower than strength of the bow.

Therefore, to measure the strength of the arrow shaft, a weight is hung on a center of the shaft, and a degree to which the arrow shaft is bent is measured. Further, the arrow shaft suitable for the strength of the bow is selected. The degree to which the arrow shaft is bent is called spine.

When the spine of the arrow shaft increases, there is an advantage in that the deformation of materials caused by the flying straightness of the arrow or the frequent paradox phenomenon less occurs. However, because the spine of the arrow needs to be determined in consideration of the strength of the bow, an unconditional increase in the spine of the arrow shaft is not necessarily advantageous. Further, there is a problem in that the increase in the spine of the arrow increases material costs and manufacturing costs.

Meanwhile, different external forces are applied to respective positions on the arrow shaft in a longitudinal direction of the arrow shaft. That is, since a frequent bending force is applied to the middle portion of the arrow shaft by the paradox phenomenon described above, the middle portion of the arrow shaft is easily weakened as the arrow is used over a long period of time. Further, the front side of the arrow shaft to which the arrowhead is coupled frequently collides with a target and receives the most amount of impact while the arrow is frequently launched. In contrast, the rear side of the arrow shaft to which the nock is coupled receives the most amount of impact applied by a bowstring.

Therefore, the necessary elasticity, strength, and physical properties of the arrow shaft need to vary depending on the positions on the arrow shaft in the longitudinal direction thereof. Therefore, the process of manufacturing the arrow shaft also needs to be performed to impart different physical properties to the respective positions on the arrow shaft. However, the arrow shaft in the related art is made of a single sheet material, which makes it impossible to meet the need.

DOCUMENT OF RELATED ART

Patent Document (Patent Document 0001) Korean Patent Application Laid-Open No. 2002-0057554 (Sep. 17, 2012)

SUMMARY OF THE DISCLOSURE

The present disclosure has been made in an effort to provide a high-stiffness arrow shaft and a method of manufacturing the same, in which all or some of a plurality of sheet layers to be wound around and stacked on a cylindrical body of the arrow shaft are formed by taping so that carbon sheets are disposed at predetermined angles and intervals, thereby providing further improved stiffness.

The present disclosure has also been made in an effort to provide a high-stiffness arrow shaft and a method of manufacturing the same, in which a plurality of sheet layers to be wound around and stacked on a cylindrical body of the arrow shaft is formed by taping so that central portions of the plurality of sheet layers are disposed at predetermined angles and intervals, thereby checking a state of a central portion of the arrow shaft, and thus easily performing maintenance such as replacement.

Technical problems of the present disclosure are not limited to the aforementioned technical problems, and other technical problems, which are not mentioned above, may be clearly understood by those skilled in the art from the following descriptions.

To achieve the above-mentioned objects, the present disclosure provides a high-stiffness arrow shaft, which has an arrowhead disposed at one side thereof and a nock disposed at the other side thereof, the high-stiffness arrow shaft including: at least one sheet layer arranged in one direction while being stacked and wound around at least a part of a body of the arrow shaft, in which at least a part of the sheet layer is made of a semi-transparent or transparent material, and a plurality of carbon fiber reinforcing sheets is disposed at predetermined angles in at least one of a plurality of sheet parts.

In the embodiment of the present disclosure, the carbon fiber reinforcing sheets may be disposed at predetermined intervals in one direction.

In the embodiment of the present disclosure, the carbon fiber reinforcing sheet may include: first carbon fiber reinforcing sheets disposed at predetermined intervals in one direction; and second carbon fiber reinforcing sheets disposed on the first carbon fiber reinforcing sheets and disposed at predetermined intervals in one direction.

In the embodiment of the present disclosure, the carbon fiber reinforcing sheets may be randomly or alternatively disposed within an inclined range of 15 to 75 degrees in a leftward/rightward direction with respect to an imaginary vertical line.

In the embodiment of the present disclosure, the carbon fiber reinforcing sheet may be formed by taping in a lattice pattern inclined by a predetermined angle.

In the embodiment of the present disclosure, strength reinforcing portions overlapping one another may be famed between the plurality of sheet parts.

In the embodiment of the present disclosure, the strength reinforcing portion may be polished and have a horizontal cross-section parallel to a longitudinal direction.

In the embodiment of the present disclosure, at least a part of the sheet layer may include at least one of carbon fibers and glass fibers.

The present disclosure provides a method of manufacturing a high-stiffness arrow shaft, the method including: a step of preparing a carbon fiber sheet in which carbon fibers are arranged in one direction; a step of forming a carbon reinforcing sheet part in which a carbon fiber reinforcing sheet is disposed at a predetermined angle on at least a part of the carbon fiber sheet; a rolling step of attaching, winding, and stacking the carbon fiber sheet having the carbon reinforcing sheet part around a mandrel having a round bar shape; a taping step of winding a film around an outermost surface of the rolled stack; a step of thermally foaming the taped stack by applying a temperature to the mandrel and the taped stack in a stepwise manner for a predetermined period of time; and a de-mandrelling step of separating the completely thermally formed stack from the mandrel.

In the embodiment of the present disclosure, the step of forming the carbon reinforcing sheet part may include forming the carbon reinforcing sheet part by randomly or alternatively disposing the carbon fiber reinforcing sheets within a range inclined by 15 to 75 degrees in a leftward/rightward direction with respect to an imaginary vertical line.

Other detailed matters of the embodiment are included in the detailed description and the drawings.

According to the high-stiffness arrow shaft and the method of manufacturing the same according to the present disclosure, all or some of the plurality of sheet layers to be wound around and stacked on the cylindrical body of the arrow shaft may be formed by taping so that the carbon sheets are disposed at predetermined angles and intervals, which makes it possible to provide further improved stiffness.

In addition, according to the high-stiffness arrow shaft and the method of manufacturing the same according to the present disclosure, the plurality of sheet layers to be wound around and stacked on the cylindrical body of the arrow shaft may be famed by taping so that the central portions of the plurality of sheet layers are disposed at predetermined angles and intervals, which makes it possible to check a state of the central portion of the arrow shaft, and thus makes it easy to perform maintenance such as replacement.

The effects of the present disclosure are not limited to the aforementioned effects, and other effects, which are not mentioned above, will be clearly understood by those skilled in the art from the claims.

DETAILED DESCRIPTION OF THE DISCLOSURE

Figure 1:
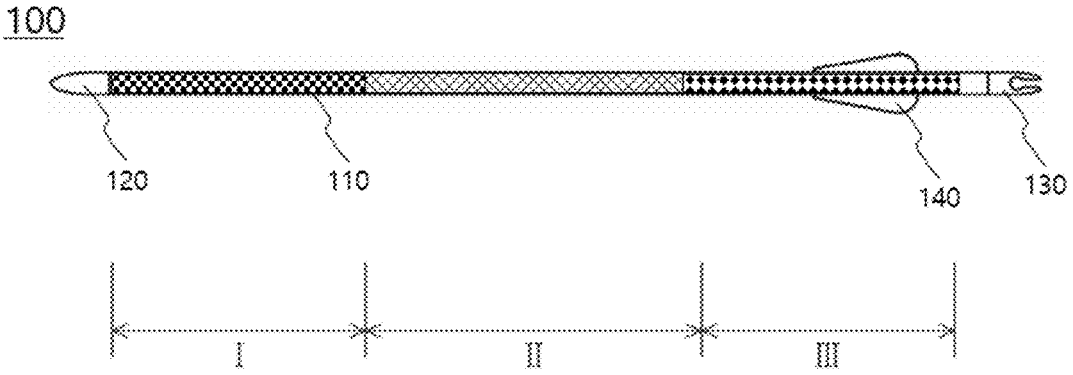
FIG. 1 is a configuration view illustrating an external appearance of an arrow according to an exemplary embodiment of the present disclosure.

Hereinafter, embodiments of the present disclosure will be described in detail with reference to the accompanying drawings. In giving reference numerals to constituent elements of the respective drawings, it should be noted that the same constituent elements will be designated by the same reference numerals, if possible, even though the constituent elements are illustrated in different drawings. Further, in the following description of the embodiments of the present disclosure, a detailed description of publicly known related configurations or functions incorporated herein will be omitted when it is determined that the detailed description obscures the subject matters of the embodiments of the present disclosure.

In addition, the tams first, second, A, B, (a), and (b) may be used to describe constituent elements of the embodiments of the present disclosure. These terms are used only for the purpose of discriminating one constituent element from another constituent element, and the nature, the sequences, or the orders of the constituent elements are not limited by the terms. Further, unless otherwise defined, all terms used herein, including technical or scientific terms, have the same meaning as commonly understood by those skilled in the art to which the present disclosure pertains. The terms such as those defined in commonly used dictionaries should be interpreted as having meanings consistent with meanings in the context of related technologies and should not be interpreted as ideal or excessively formal meanings unless explicitly defined in the present application.

Hereinafter, a high-stiffness arrow shaft according to an embodiment of the present disclosure will be described with reference to the drawings.

FIG. 1 is a configuration view illustrating an external appearance of an arrow according to an embodiment of the present disclosure. The arrow 100 according to the present disclosure includes an arrow shaft body 110 having a hollow tubular shape. As illustrated, the arrow shaft body 110 is divided into three portions from a front end to which an arrowhead 120 is coupled to a rear end to which a nock 130 is coupled. That is, the arrow shaft 101 is divided into a front portion I, a middle portion II, and a rear portion III in a longitudinal direction from the front end to the rear end thereof. Non-described reference numeral 140 in the drawings indicates fletching of the arrow.

A carbon fiber sheet 200 to be wound around the arrow shaft body 110 may be provided as a sheet in which carbon fiber layers are stacked. A transfer layer (not illustrated) may be formed on one surface of a camouflage layer (not illustrated) which is wound around an outermost side of the carbon fiber sheet 200 and defines patterns or shapes.

In this case, according to the present disclosure, carbon fiber reinforcing sheets 10 and 20 (FIG. 5) may be disposed in at least a part of the outermost side of the carbon fiber sheet 200 to be wound around the arrow shaft body 110. The carbon fiber reinforcing sheets 10 and 20 may be disposed at predetermined intervals and inclined at predetermined angles. The carbon fiber reinforcing sheet will be described in more detail below with reference to the drawings.

The arrow shaft body 110 may be formed by impregnating a plurality of carbon fibers, a plurality of glass fibers, or a plurality of carbon fibers arranged side by side in one direction with transparent or semi-transparent resin or processing the plurality of fibers with prepreg. That is, the arrow shaft body 110 may be manufactured by impregnating the carbon fibers with resin such as epoxy resin, polyester resin, and thermoplastic resin.

Figure 2:
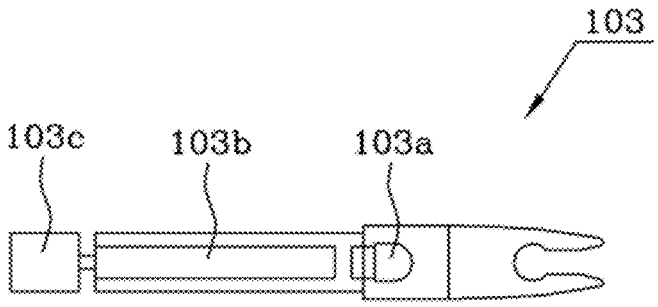
FIGS. 2 and 3 are cross-sectional views exemplarily illustrating a nock and a structure of a light-emitting means mounted on an arrow shaft according to the present disclosure.
Figure 3:
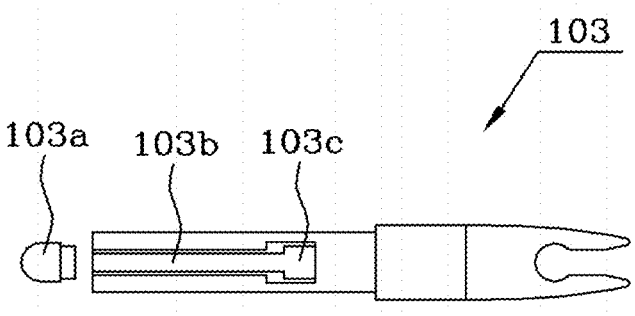

Meanwhile, in the illustrated embodiment, the rear portion III of the arrow shaft 101 is made of a transparent or semi-transparent material, and the nock 130 is coupled to the rear end of the rear portion III of the arrow shaft 101. FIGS. 2 and 3 are cross-sectional views exemplarily illustrating a nock and a structure of a light-emitting means mounted on the arrow shaft according to the present disclosure. The light-emitting means illustrated in FIG. 2 has a structure generally adopted in the related art. A light source 103*a* such as a LED is mounted in the nock and disposed adjacent to a portion of the nock to which a bowstring is fixed. A battery 103*b* is mounted in the nock 130 and slidable in a longitudinal direction of the nock. A switch 103*c* is disposed at a side of the battery 103*b* opposite to the side of the battery 103*b* to which the light source 103*a* is coupled. The switch 103*c* is connected to the battery 103*b*.

The battery 103*b* is spaced apart from the light source 103*a* so as not to be in contact with the light source 103*a* at normal times. When the bowstring is drawn together with the nock 130, the switch 103*c* and the battery 103*b* slide to the right and come into contact with the light source 103*a*, such that the light source 103*a* is electrically turned on. In this case, the switch 103*c* is fixedly mounted on an inner peripheral wall of the arrow shaft body 110.

FIG. 3 illustrates that the above-mentioned light-emitting structure is disposed in a reverse manner. That is, the light source 103*a* is positioned outside the nock 130 and fixedly mounted on the inner peripheral wall of the arrow shaft body 110 instead of being mounted in the nock 130. Further, the battery 103*b* and the switch 103*c* connected to the battery 103*b* are mounted in the nock 130 and slidable to the left and right, as illustrated.

With the above-mentioned structure, the light source 103*a* is not turned on even though the nock 130 is pulled with the bow. At the moment when the launched arrow hits the target, the switch 103*c* and the battery 103*b* are slid toward the front side of the arrow shaft body 110 by inertia and come into contact with the light source 103*a*, such that the light source 103*a* is electrically turned on and emits light.

In the present embodiment, since the rear portion III of the arrow shaft 101 is made of a transparent or semi-transparent material, the light in the arrow shaft body 110 propagates to the outside of the arrow shaft body 110, which makes it possible to improve long-distance visibility at night.

The example of the structure of the light-emitting means is just provided to explain the present disclosure. Any structure related to the light-emitting means and publicly known in the related art may be applied as the structure of the light-emitting means to be applied to the present disclosure.

Figure 4:
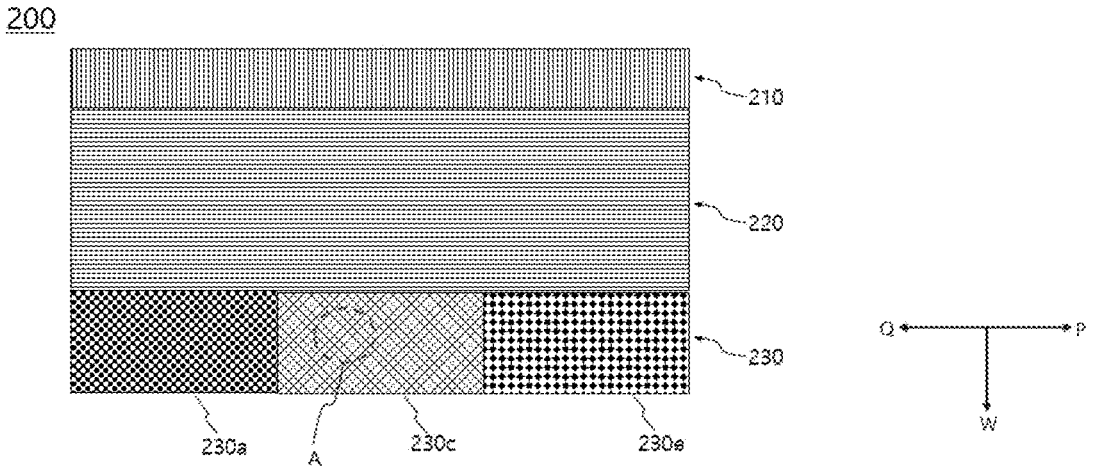
FIG. 4 is a development view of an arrow shaft sheet according to the embodiment of the present disclosure.
Figure 5:
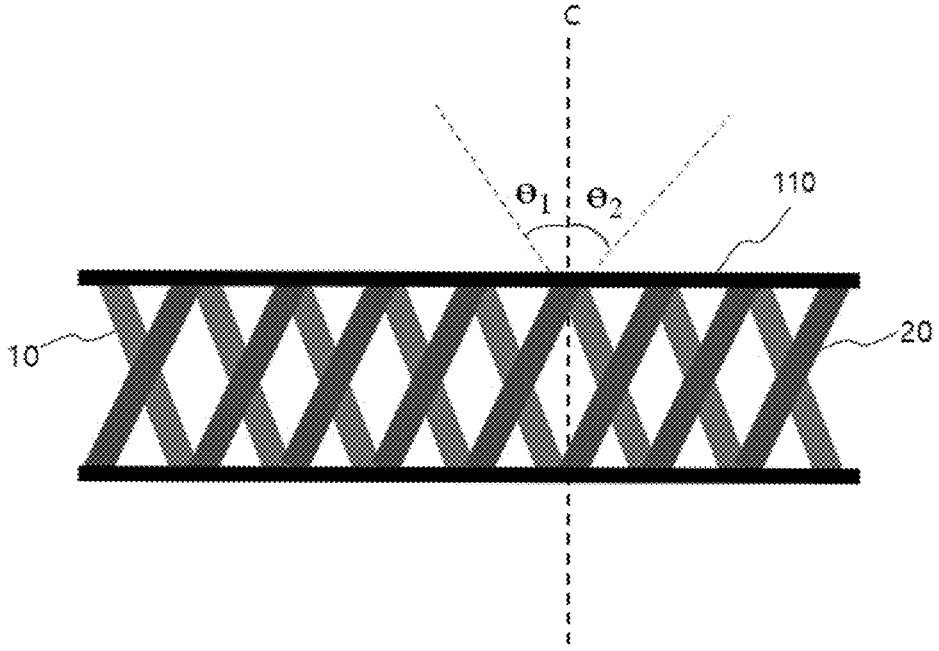
FIG. 5 is a partially enlarged view of part 'A' in FIG. 4.

FIG. 4 is a development view of an arrow shaft forming sheet according to the embodiment of the present disclosure, and FIG. 5 is a partially enlarged view of a part of the development view of the forming sheet illustrated in FIG. 4. The arrow shaft 100 is formed by using the illustrated arrow shaft forming sheet 200. The arrow shaft 100 is manufactured by sequentially performing a cutting process, a stacking process, a winding process, a taping process, a heat treatment/cooling process, a de-mandrelling process, and a polishing process on the forming sheet 200.

The arrow shaft forming sheet 200 may be configured as an elastic sheet such as a carbon fiber sheet or a glass fiber sheet or configured as a combination of an inelastic sheet such as a fiber sheet with printed or transferred camouflage patterns.

The arrow shaft forming sheet 200 according to the present embodiment broadly includes a first sheet layer 210 which is a lowermost layer, a second sheet layer 220 which is an intermediate layer, and a third sheet layer 230 which is an uppermost layer. In the first sheet layer 210, a plurality of carbon or glass fibers is continuously arranged side by side in one direction (a vertical direction in the drawings). In the second sheet layer 220, a plurality of glass fibers is continuously arranged side by side in the other direction (a horizontal direction in the drawings).

Strength reinforcing portions (not illustrated) may be provided to overlap one another in connection portions between the first sheet layer 210, the second sheet layer 220 which is the intermediate layer, and the third sheet layer 230 which is the uppermost layer. In addition, the strength reinforcing portions may be provided to overlap one another in connection portions between a front sheet 230*a*, an intermediate sheet 230*c*, and a rear sheet 230*e* of the third sheet layer 230.

The third sheet layer 230 is made of materials different depending on the positions on the third sheet layer 230 that correspond to the front portion I, the middle portion II, and the rear portion III of the arrow shaft. The front sheet 230*a*, which is a portion of the forming sheet 200 corresponding to the front portion I, is a sheet layer having an arrangement of carbon fibers. The intermediate sheet 230*c*, which is a portion of the forming sheet 200 corresponding to the middle portion II, is a sheet layer in which a plurality of carbon fiber reinforcing sheets is disposed at predetermine angles and intervals. The rear sheet 230*e*, which is a portion of the forming sheet 200 corresponding to the rear portion III, is a sheet layer made of a transparent or semi-transparent material. The rear sheet 230*e* made of a transparent or semi-transparent material is formed by impregnating the glass fibers with transparent or semi-transparent resin or processing the glass fibers with prepreg.

In this case, according to the present disclosure, in the intermediate sheet 230*c*, the plurality of carbon fiber reinforcing sheets is alternately disposed at predetermined intervals within a range of ±15 to ±75 degrees with respect to the longitudinal direction of the arrow shaft body 110. Particularly, the plurality of carbon fiber reinforcing sheets may be appropriately disposed at predetermined intervals and inclined by taping within the range of approximately ±30 to ±60 degrees. More particularly, the plurality of carbon fiber reinforcing sheets may be disposed at predetermined intervals and inclined at ±45 degrees by taping.

Of course, the inclination and interval at which the plurality of carbon fiber reinforcing sheets for forming the intermediate sheet 230*c* is disposed are not particularly limited. For example, the plurality of carbon fiber reinforcing sheets may of course be disposed at desired angles and intervals to adjust the strength of the arrow shaft 100.

Further, a width of the plurality of carbon fiber reinforcing sheets for forming the intermediate sheet 230*c* according to the present disclosure may be adjusted to various sizes under a predetermined condition.

Specifically, as illustrated in FIG. 4, the intermediate sheet 230*c* of the forming sheet 200 according to the present disclosure may include the plurality of first carbon fiber reinforcing sheets 10 disposed at predetermined intervals in one direction, and the plurality of second carbon fiber reinforcing sheets 20 disposed on the first carbon fiber reinforcing sheets 10 and disposed at predetermined intervals in one direction.

The method of arranging the first and carbon fiber reinforcing sheets 10 and 20 is not particularly limited as long as the method has a structure for improving the stiffness of the arrow shaft. For example, the first and second carbon fiber reinforcing sheets 10 and 20 may be randomly disposed to be inclined at predetermined angles. Alternatively, the first and second carbon fiber reinforcing sheets 10 and 20 may be alternately disposed to be inclined at predetermined angles. Therefore, a user may directly check damage such as cracks in a central portion of the arrow shaft 100 and thus easily recognize the replacement timing.

The drawings according to the present disclosure are provided merely to show that the first and second carbon fiber reinforcing sheets 10 and 20 are formed by taping. However, the width and size of the carbon fiber reinforcing sheet and the number of carbon fiber reinforcing sheets are not limited thereto.

In some instances, the first and second carbon fiber reinforcing sheets 10 and 20 may be manufactured in a shape in which a plurality of fiber strands (not illustrated) is randomly arranged. In addition, the first and second carbon fiber reinforcing sheets 10 and 20 may each be manufactured as an adhesive tape having one adhesive surface.

In this case, the first and second carbon fiber reinforcing sheets 10 and 20 may be disposed to be inclined at predetermined inclinations ($\Theta_1$ and $\Theta_2$) in leftward and rightward directions, i.e., in opposite directions with respect to an imaginary vertical line C of the arrow shaft body 110. That is, the first and second carbon fiber reinforcing sheets 10 and 20 may be formed in a lattice pattern by taping and inclined at predetermined angles.

As illustrated in FIG. 4, the plurality of first carbon fiber reinforcing sheets 10 may be disposed to be inclined in the leftward direction by approximately 45 degrees with respect to the imaginary vertical line C. The second carbon fiber reinforcing sheets 20 may be disposed to be inclined in the rightward direction by approximately 45 degrees with respect to the imaginary vertical line C. The first and second carbon fiber reinforcing sheets 10 and 20 may be arranged in various ways. For example, the first carbon fiber reinforcing sheets 10 may be disposed at predetermined intervals and inclined by approximately 45 degrees, and then the second carbon fiber reinforcing sheets 20 may be disposed on the first carbon fiber reinforcing sheets 10 at predetermined intervals, and inclined by approximately 45 degrees. Alternatively, the first fiber reinforcing sheet among the first carbon fiber reinforcing sheets 10 may be disposed, and then the first fiber reinforcing sheet among the second carbon fiber reinforcing sheets 20 may be disposed, such that the first and second carbon fiber reinforcing sheets 10 and 20 may be alternately and continuously formed in one direction.

Therefore, the carbon fiber layers may be stacked on the central portion of the arrow shaft body 110, which makes it possible to provide the high-stiffness arrow shaft 100.

In some instances, the taping may be performed by adjusting the inclination angles of and the intervals between the first and second carbon fiber reinforcing sheets 10 and 20 that constitute the carbon fiber sheet 200 according to the present disclosure.

The drawings according to the present disclosure illustrate examples in which the intermediate sheet 230*c* of the third sheet layer 230 is formed in the carbon fiber sheet 200, but the present disclosure is of course not limited thereto.

Figure 6:
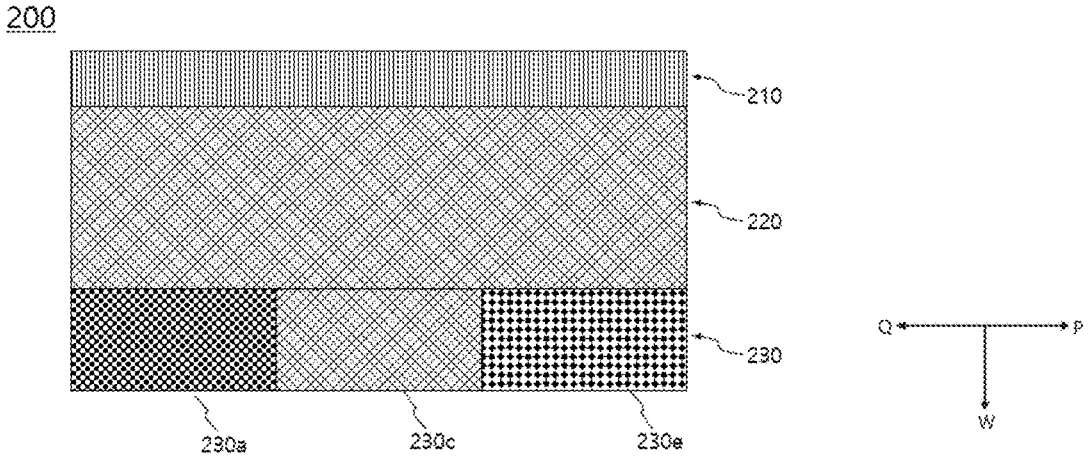
FIGS. 6 to 8 are development views of arrow shaft sheets according to other embodiments of the present disclosure.
Figure 7:
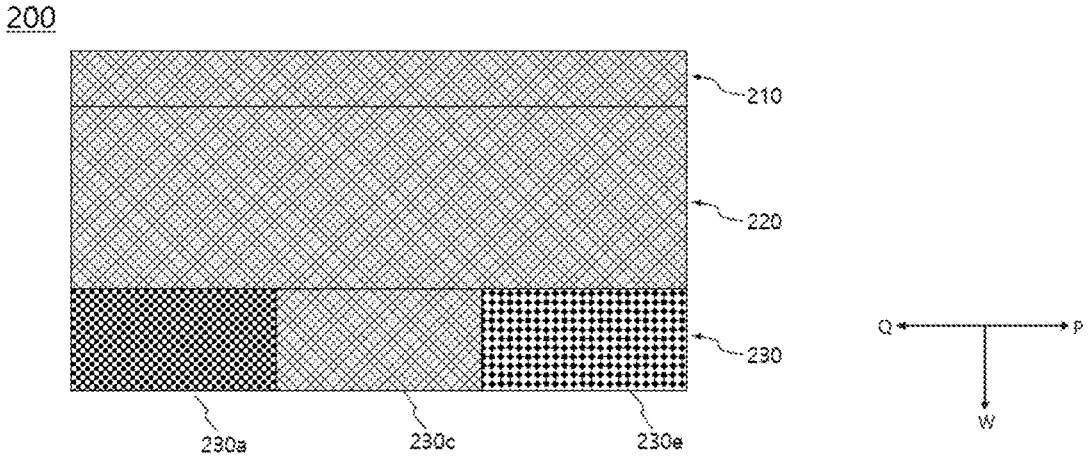
Figure 8:
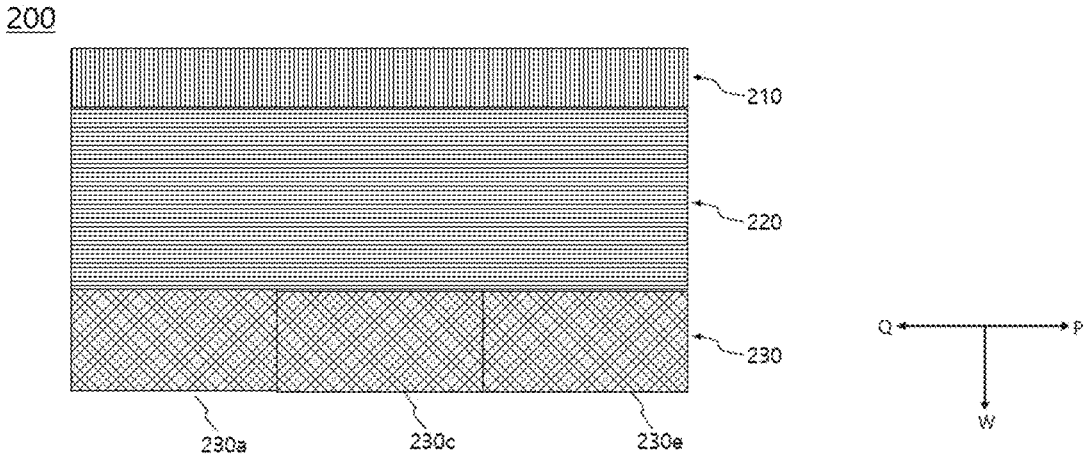
Figure 9:
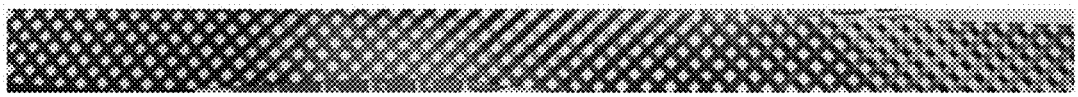
FIG. 9 is a photograph of a carbon fiber sheet of the arrow shaft sheet according to the embodiment of the present disclosure.

The carbon fiber reinforcing sheets 10 and 20 having lattice patterns and formed at predetermined inclinations and intervals may be selectively formed in the first sheet layer 210, the second sheet layer 220, and the third sheet layer 230, as illustrated in FIGS. 6 and 8. In addition, the carbon fiber reinforcing sheets 10 and 20 may also be famed in the front sheet 230*a* and the rear sheet 230*e* in addition to the intermediate sheet 230*c* of the third sheet layer 230.

Meanwhile, the front portion I, the middle portion II, and the rear portion III of the arrow shaft according to the present embodiment is formed by winding the forming sheet 200 around a metal mandrel having a rod shape and performing the above-mentioned processes.

As described above, the first sheet layer 210, the second sheet layer 220, and the third sheet layer 230 may be connected by the strength reinforcing portions, and the front sheet 230*a*, the intermediate sheet 230*c*, and the rear sheet 230*e* of the third sheet layer 230 may be connected by the strength reinforcing portions.

As a material used to manufacture the arrow shaft 101, an elastic sheet such as a carbon fiber sheet or a glass fiber sheet and an inelastic sheet formed by processing natural fibers or synthetic fibers with prepreg are used, and a carbon fiber sheet, which is a kind of elastic sheet, may be mainly used. There are various types of carbon fiber sheets and glass fiber sheets depending on the purposes thereof, and tensile strength, elastic moduli, elongation percentages, weights, and density thereof vary depending on the types or models of carbon fiber sheets and glass fiber sheets.

A tonnage of the carbon fiber or glass fiber prepreg sheet means a weight applied to a size of 1 mm in horizontal size and vertical size. For example, a tonnage of 24 of the carbon fiber sheet indicates 24 TON/mm$^2$. Therefore, a higher tonnage of the carbon fiber sheet indicates a sheet having a higher strength and elasticity. Therefore, in the following description, the tonnage of the carbon fiber sheet is defined and used as the same concept as the spine and the elastic strength.

There are various kinds of carbon fiber sheets and glass fiber sheets processed with prepreg (hereinafter, simply referred to as a carbon fiber sheet or a glass fiber sheet), and various models from sheets having general elasticity to high-elasticity sheets having very high elasticity are being produced. The tensile strength, elastic modulus, tensile modulus, extensibility, and mass and density per unit length thereof vary depending on the elasticity thereof.

Assuming that the carbon fiber sheet or the glass fiber sheet generally has a constant thickness, it can be said that the carbon fiber sheet or glass fiber sheet has excellent elastic strength when the large number of carbon fibers or glass fibers are arranged per unit area or the carbon fibers or glass fibers are heavy.

In addition, the carbon fiber woven fabric or the glass fiber woven fabric made by crossing and weaving the carbon fibers or the glass fibers arranged in different directions is excellent in elastic strength and does not separate easily in comparison with the sheet only made of carbon fibers or glass fibers arranged in one direction.

The first sheet layer 210 may be the sheet layer, which is the lowermost layer directly in contact with and attached to the mandrel, and famed as a relatively low-elasticity low-strength carbon fiber sheet or glass fiber sheet. When the first sheet layer 210 is made of a glass fiber sheet, transparency of the arrow shaft body 110 is improved.

The second sheet layer 220 is connected to the first sheet layer 210 so that the first sheet layer 210 is orthogonal to the arrangement of the glass fibers. The third sheet layer 230 may be divided into the three portions in the longitudinal direction of the arrow shaft body 110, and the carbon fiber sheets or the glass fiber sheets may be differently formed for the respective portions.

A sheet, in which carbon fibers CF are more densely disposed than the second sheet layer 220 is selected as the front sheet 230*a* for the front portion I of the arrow shaft body 110. Further, a transparent or semi-transparent sheet made by processing the glass fibers with prepreg by using epoxy resin or the like is selected as the rear sheet 230*e* for the rear portion III. In this case, the strength of the rear sheet 230*e* may become lower or higher than the strength of the front sheet 230*a* by adjusting density or the like of the glass fibers.

A sheet having higher elastic strength (spine strength) than the rear sheet 230*e* may be selected as the intermediate sheet 230*c* for the middle portion II. Therefore, in the case of the third sheet layer 230 which is the outermost peripheral sheet layer among the sheet layers wound around the outer peripheral surface of the mandrel, the middle portion II has higher spine strength than the front portion I and the rear portion III. For example, the order of the spine strength of the arrow shaft body 110 thus formed may be the middle portion II, the rear portion III, and the front portion I.

Of course, the order of the strength of the front portion I, the middle portion II, the rear portion III may be different from the above-mentioned order, as necessary.

For example, in the present embodiment, regarding a length of each of the front portion I, the middle portion II, and the rear portion III when an overall length of the arrow shaft body 110 is 100, a length of the front portion I may be 30% of the overall length, a length of the middle portion II may be 40% of the overall length, and a length of the rear portion III may be 30% of the overall length. However, it is not necessary to manufacture the arrow shaft at a ratio necessarily restricted to the above-mentioned ratio, and the ratio may be changed or adjusted as much as needed, as necessary.

As described above, with the arrow shaft body 110 having the structure in which the carbon fiber reinforcing sheets 10 and 20 are disposed by predetermined angles and intervals, the stiffness of the entire arrow shaft may be reinforced. Therefore, it is possible to prevent damage to and deformation of the arrow shaft caused by repeated impact and a paradox phenomenon, thereby preventing deformation of and damage to the front portion I and the rear portion III of the arrow shaft body 110 caused by the frequent launching of the arrow.

Further, necessary elasticity or spine strength is differently imparted to the arrow shaft body 110 depending on the positions of the arrow shaft body 110 in the longitudinal direction, which makes it possible to improve flying stability or straightness of the arrow.

A method of manufacturing the arrow shaft by using the arrow shaft forming sheet 110 will be described below.

First, a release agent is applied onto the entire outer peripheral surface of the mandrel (not illustrated) so that the mandrel is easily separated, and then a bonding agent is applied onto the outer peripheral surface of the mandrel. The arrow shaft forming sheet 200, which is processed with prepreg and properly cut into a predetermined length, is wound around and attached to the outer peripheral surface of the mandrel. Specifically, the first sheet layer 210, which is an end portion of the arrow shaft forming sheet 200, is attached to the surface of the mandrel, and then the arrow shaft forming sheet 200 is stacked on and wound around the mandrel by a rolling device (not illustrated). This process is referred to as a rolling process. In this case, the intermediate sheet 230*c* formed by taping the plurality of carbon fiber reinforcing sheets 10 and 20 at predetermined angles and intervals according to the present disclosure is formed at the lower side of the forming sheet 200, i.e., a portion disposed at the uppermost end after the winding process.

After the rolling process is completed, a film is wound around the outermost surface of the mandrel stack by using a taping device (not illustrated). This process is referred to as a taping process, and a PET film or an OPP film may be used as the film. The taping process is performed before the product, which has been subjected to the rolling process, is famed. The taping process serves to discharge air remaining between the sheet layers to the outside and improve interior stacking performance in the product.

Thereafter, the product is formed by changing temperatures of the taped stack of the mandrel and the sheets in a stepwise manner for a predetermined period of time, and then the product is separated from the mandrel. In this case, a preferable forming temperature is within a range of about 80 to 150° C., and a heating time is properly about 1 to 4 hours.

Finally, two opposite ends of the arrow shaft main body separated from the mandrel are cut into a necessary length, for example, about 825 mm, the film is peeled off, and then the outer peripheral surface of the arrow shaft main body is polished by a centerless polishing process, thereby manufacturing the arrow shaft 100 according to the present embodiment.

It may be understood by a person skilled in the art that the present disclosure may be carried out in other specific forms without changing the technical spirit or the essential characteristics of the present disclosure. Therefore, it should be understood that the above-described embodiments are illustrative in all aspects and do not limit the present disclosure. The scope of the present disclosure is represented by the claims to be described below rather than the detailed description, and it should be interpreted that the meaning and scope of the claims and all the changes or modified forms derived from the equivalent concepts thereto fall within the scope of the present disclosure.

DESCRIPTION OF REFERENCE NUMERALS

10: First carbon fiber reinforcing sheet
20: Second carbon fiber reinforcing sheet
100: Arrow
103*a*: Light source
103*b*: Battery
103*c*: Switch
110: Arrow shaft body
120: Arrowhead
130: Nock
210: First sheet layer
220: Second sheet layer
230: Third sheet layer
230*a*: Front sheet
230*c*: Intermediate sheet
230*e*: Rear sheet
I: Front portion
II: Middle portion
III: Rear portion

What is claimed is:

1. A high-stiffness arrow shaft, which has an arrowhead disposed at one side thereof and a nock disposed at the other side thereof, the high-stiffness arrow shaft comprising:

at least one sheet layer arranged in one direction while being stacked and wound around at least a part of a body of the arrow shaft, wherein at least a part of the sheet layer is made of a semi-transparent or transparent material, and a plurality of carbon fiber reinforcing sheets is disposed at predetermined angles in at least one of a plurality of sheet parts.

2. The high-stiffness arrow shaft of claim 1, wherein the carbon fiber reinforcing sheets are disposed at predetermined intervals in one direction.

3. The high-stiffness arrow shaft of claim 1, wherein the carbon fiber reinforcing sheet comprises:

first carbon fiber reinforcing sheets disposed at predetermined intervals in one direction; and second carbon fiber reinforcing sheets disposed on the first carbon fiber reinforcing sheets and disposed at predetermined intervals in one direction.

4. The high-stiffness arrow shaft of claim 1, wherein the carbon fiber reinforcing sheets are randomly or alternatively disposed within an inclined range of 15 to 75 degrees in a leftward/rightward direction with respect to an imaginary vertical line.

5. The high-stiffness arrow shaft of claim 1, wherein the carbon fiber reinforcing sheet is formed by taping in a lattice pattern inclined by a predetermined angle.

6. The high-stiffness arrow shaft of claim 1, wherein strength reinforcing portions overlapping one another are formed between the plurality of sheet parts.

7. The high-stiffness arrow shaft of claim 6, wherein the strength reinforcing portion is polished and has a horizontal cross-section parallel to a longitudinal direction.

8. The high-stiffness arrow shaft of claim 1, wherein at least a part of the sheet layer includes at least one of carbon fibers and glass fibers.

* * * * *